US007726902B1

(12) United States Patent
Bongiovanni et al.

(10) Patent No.: US 7,726,902 B1
(45) Date of Patent: Jun. 1, 2010

(54) LOCKING COVER FOR WELLS AND UNDERGROUND TANKS

(76) Inventors: Brad Bongiovanni, 11015 Perkins Rd., Baton Rouge, LA (US) 70810; Shawn Funderburk, 1613 Somersby Ave., Baton Rouge, LA (US) 70817

( * ) Notice: Subject to any disclaimer, the term of this patent is extended or adjusted under 35 U.S.C. 154(b) by 49 days.

(21) Appl. No.: 11/535,262

(22) Filed: Sep. 26, 2006

Related U.S. Application Data

(63) Continuation of application No. 10/657,543, filed on Sep. 8, 2003, now Pat. No. 7,144,189.

(60) Provisional application No. 60/408,808, filed on Sep. 6, 2002.

(51) Int. Cl.
*E02D 29/14* (2006.01)

(52) U.S. Cl. ..... 404/25; 137/371

(58) Field of Classification Search ..... 404/25; 52/19, 20; 137/371; 220/3.8
See application file for complete search history.

(56) References Cited

U.S. PATENT DOCUMENTS

| | | | | |
|---|---|---|---|---|
| 891,174 | A | 6/1908 | Hurlburt | |
| 897,046 | A | 8/1908 | Armstrong | |
| 911,256 | A | 2/1909 | McWane | |
| 1,287,290 | A * | 12/1918 | Golden | 49/35 |
| 1,384,712 | A | 7/1921 | Shanley | |
| 1,458,391 | A | 6/1923 | Burton | |
| 1,616,298 | A | 2/1927 | Arnett | |
| 2,323,886 | A * | 7/1943 | Wirz, Jr. | 292/304 |
| 2,363,567 | A * | 11/1944 | Blakeman | 292/6 |
| 3,530,696 | A | 9/1970 | Dunmire | |
| 4,577,478 | A | 3/1986 | Economopoulos et al. | |
| 4,928,615 | A * | 5/1990 | Williams | 114/203 |
| 4,964,755 | A | 10/1990 | Lewis et al. | |
| 5,071,177 | A | 12/1991 | Spiess et al. | |
| 5,082,392 | A | 1/1992 | Marchese et al. | |
| 5,160,213 | A | 11/1992 | Spiess et al. | |
| 5,283,979 | A * | 2/1994 | Carlson et al. | 49/395 |
| 5,291,845 | A * | 3/1994 | Vallery | 114/203 |
| 5,324,135 | A | 6/1994 | Smith | |
| 5,625,524 | A | 4/1997 | Konagaya et al. | |
| 5,697,729 | A | 12/1997 | Bowman | |
| 5,950,368 | A | 9/1999 | Bradford | |
| 5,997,210 | A | 12/1999 | Shirakawa | |
| 6,007,270 | A | 12/1999 | Bowman | |
| 6,550,294 | B2 | 4/2003 | Garguilo | |
| 6,739,796 | B1 | 5/2004 | Del Nero et al. | |
| 7,144,189 | B1 * | 12/2006 | Bongiovanni et al. | 404/25 |

(Continued)

FOREIGN PATENT DOCUMENTS

| | | |
|---|---|---|
| EP | 420777 | 4/1991 |

(Continued)

*Primary Examiner*—Gary S Hartmann
(74) *Attorney, Agent, or Firm*—Garvey, Smith, Nehrbass & North, L.L.C.; Charles C. Garvey, Jr.; Seth M. Nehrbass

(57) ABSTRACT

A locking cover apparatus for an opening in the ground is disclosed. The apparatus can be retro-fitted to an existing ground opening, or can be newly constructed ground opening fitted with the apparatus of the present invention. The apparatus features a keyed lock that has a projecting portion that fits under an existing or newly constructed shroud that is installed at ground level and around the ground opening.

31 Claims, 6 Drawing Sheets

U.S. PATENT DOCUMENTS 7,347,070 B1 * 3/2008 Spector ..... 70/169

FOREIGN PATENT DOCUMENTS

JP 5625524 3/1981
JP 6158673 6/1994
JP 6248660 9/1994
JP 11229479 8/1999

* cited by examiner

LOCKING COVER FOR WELLS AND UNDERGROUND TANKS

CROSS-REFERENCE TO RELATED APPLICATIONS

Priority of our U.S. Provisional Patent Application Ser. No. 60/408,808, filed 6 Sep. 2002, incorporated herein by reference, is hereby claimed.

This is a continuation of prior, copending application Ser. No. 10/657,543, filed Sep. 8, 2003, now U.S. Pat. No. 7,144,189 and hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to manhole covers, particularly lockable covers for catch basins, wells, test wells, piping systems, sewerage systems, remote gasoline fill ports, and the like. More particularly, the present invention relates to an improved locking cover for a manhole, catch basin, well, test well or the like wherein a specially configured locking cover has interlocking portions that are spaced circumferentially apart, wherein one of the interlocking portions is a keyed lock that extends from the upper surface of the lid to the lower surface of the lid and that rotates a locking arm to a position under a shoulder of a shroud that receives the lid.

2. General Background of the Invention

The present invention provides a well shroud and security system. The shroud is disposed over the end of a well, e.g. an environmental monitoring well pipe, or water well pipe, or any well system or like ground opening. The shroud and well pipe can be set in concrete. The space between the housing and the well pipe is preferably filled with concrete below the end of the well pipe.

The shroud provides an interior ledge for receiving and supporting a locking cover that can be a hinged locking cover. The locking cover can also be a one piece cover that has a plurality of interlocking portions spaced circumferentially (for example, 180°) around the periphery of the lid. The shroud has an interior ledge or shoulder for receiving and supporting the locking cover.

A flexible gasket can be placed on the ledge or shoulder. The cover can be placed on the flexible gasket. The cover and flexible gasket are secured by means of a locking mechanism.

The cover thickness is preferably substantially the same as the distance from the top of the housing downwardly to the shoulder or ledge, so that when locked, the top is flush with the ground surface.

The locking device of the present invention can be recessed, preferably covered with a flexible gasket. The gasket helps seal out weather, unwanted elements, dirt, and debris from the keyed opening of the lock.

The hinge on the cover can be internal for a more secure shroud. The underside of the cover can provide a metal plate fastened to the underside of the lid with four bolts. The bolts can be positioned, for example, at corners of the plate for marking and engraving well numbers or other site specific information.

The present invention thus provides a lockable ground opening with an improved cover and locking arrangement that is preferably a hinged, flush mounted cover.

The hinge is preferably mounted inside the cover for security.

A top cover portion of the apparatus accepts a lock for security. The lock can be a redundant device for security purposes. The underside of the cover accepts a plate for site specific information. In one embodiment, the cover is a one piece unit that can be retroactively fitted to an existing shroud.

The following patent documents are incorporated herein by reference: U.S. Pat. Nos. 5,160,213; 5,324,135; 5,697,729; 5,950,368; 6,007,270; foreign patent document nos. JA 56-25524; JA61-58673; EP 420,777; JA6-248,660.

U.S. Pat. No. 6,007,270 discloses a manhole frame with a hinged lid that has a lock on the side.

U.S. Pat. No. 5,324,135 discloses a hinged locking lid for a ground opening.

U.S. Pat. No. 5,697,729 discloses a locking lid for a ground opening.

U.S. Patent No. JA 56-25524 and EP 420,777 discloses locking lids for manhole covers that are pivoted or hinged.

BRIEF SUMMARY OF THE INVENTION

The apparatus of the present invention comprises a locking lid for wells and underground tanks. There are two embodiments disclosed herein. One embodiment includes the housing and the lid, wherein the lid is hinged to the housing and includes a keyed lock to lock the lid in place. The other embodiment is a retrofit lid which does not hinge, but that fits existing housing and locks in place with a keyed lock. In both embodiments, there is preferably a plate, on which pertinent information can be engraved, which can be bolted to the inside of the lid.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figures 1, 1A:
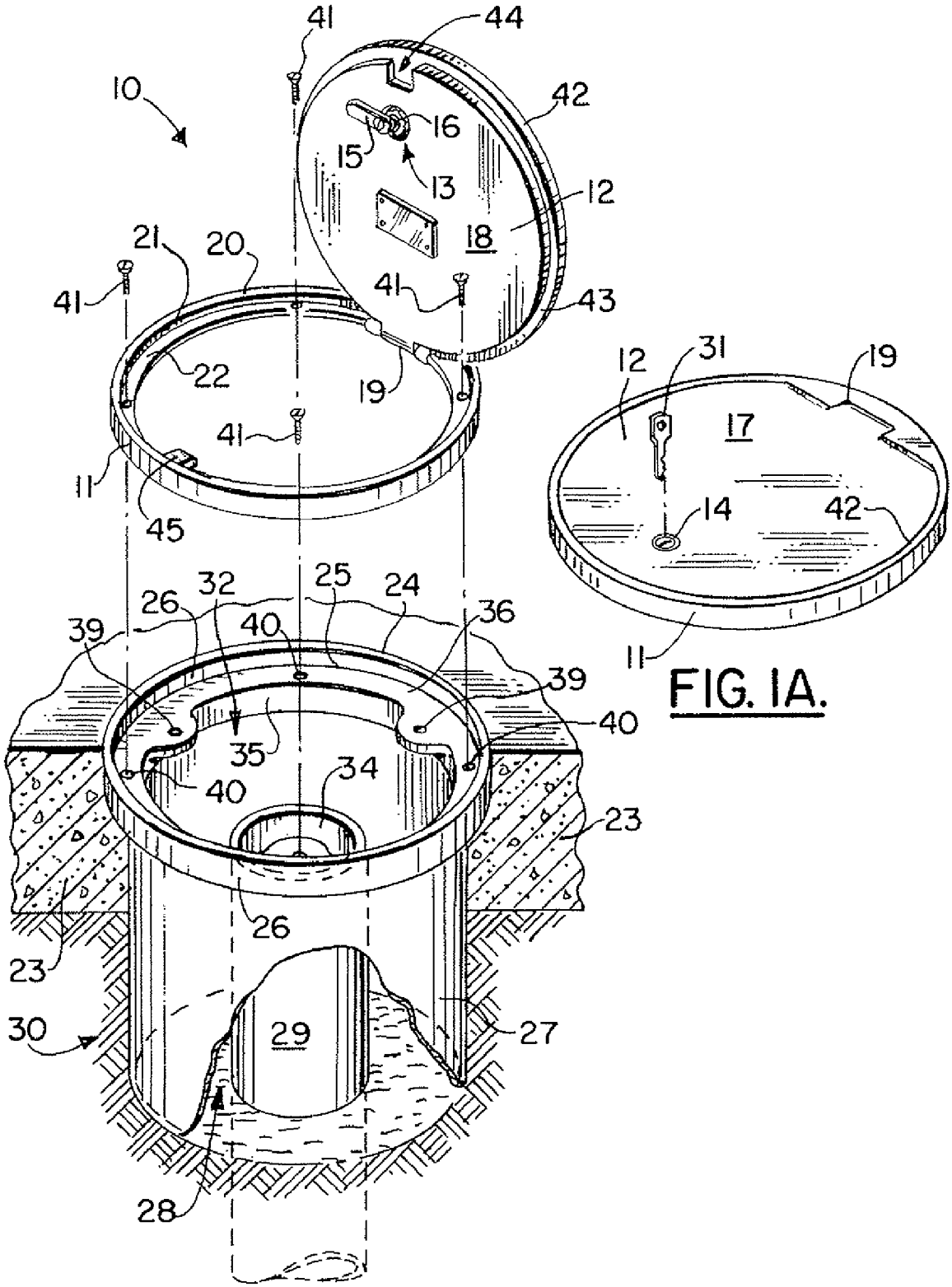
FIG. 1 is perspective exploded view of the preferred embodiment of the apparatus of the present invention, showing a hinged lid arrangement.
FIG. 1A is a partial perspective view of the preferred embodiment of the apparatus of the present invention, showing the shroud that operates with the lid of FIG. 3.
Figure 2:
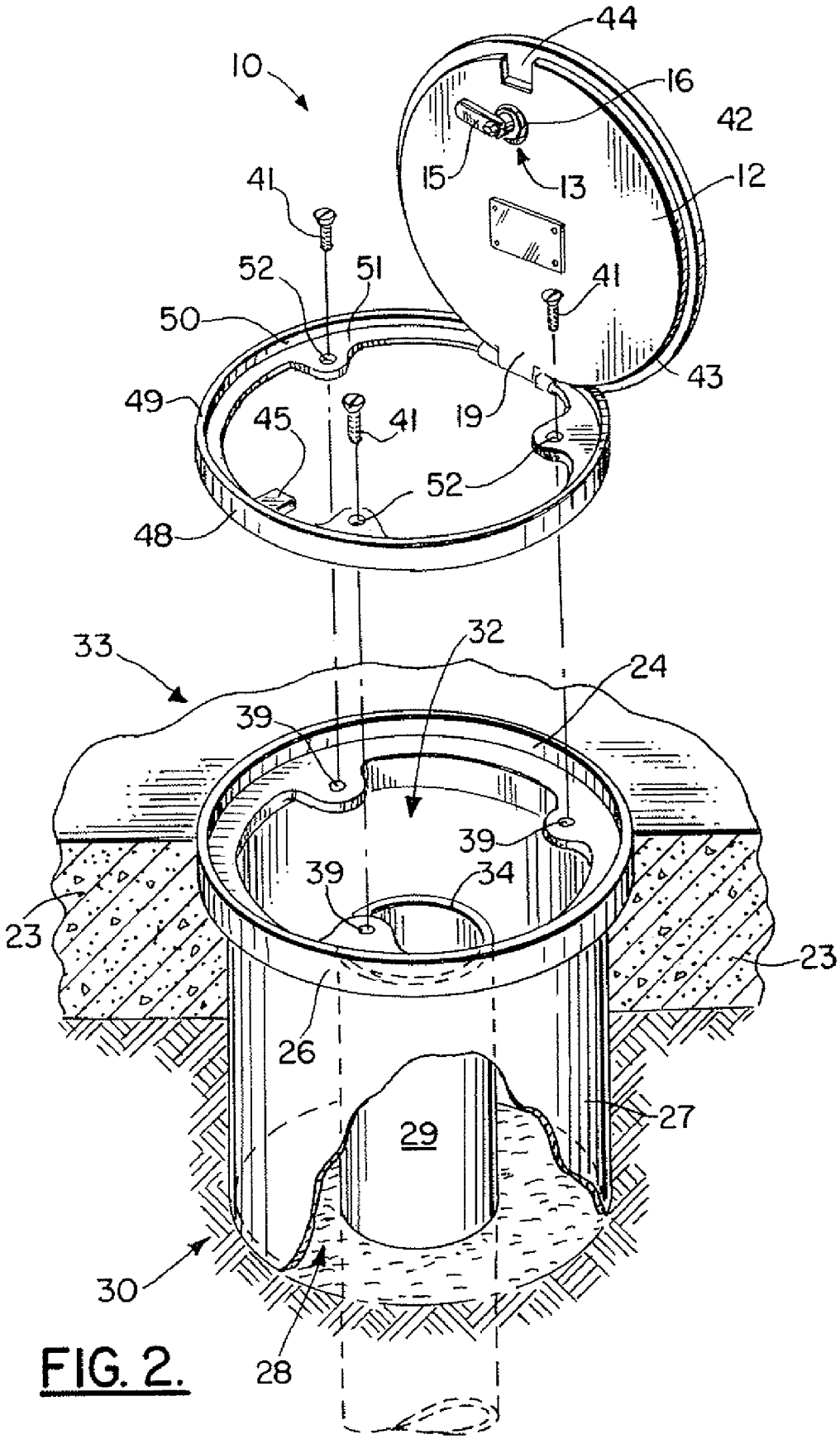
FIG. 2 is a perspective exploded view of a second embodiment of the apparatus of the present invention.

FIGS. 1, 1A, 2 and 3 show the preferred embodiment of the apparatus of the present invention, designated generally by the numeral 10 in FIGS. 1 and 2. Locking ground opening cover apparatus 10 includes a shroud 11 that is fitted with a specially configured lid 12 having a locking mechanism 13. Lid 12 provides an upper surface 17 and a lower surface 18. A hinge 19 is attached to lid 12 generally opposite locking mechanism 13. The locking mechanism 13 preferably includes a key slot 14 for receiving a key 31 so that a user can access a well 30 or like ground opening by separating the lid 12 from the shroud 11 or by pivoting the lid 12 upon the shroud 11.

The locking mechanism 13 preferably includes a locking arm 15 that is mounted to rotating section 16. In this fashion, a user opens lid 12 by placing the appropriate key 31 in key slot 14 and rotates the rotating section 16 and locking arm 15 until the locking arm 15 is in an unlocking position that places it under lid 12 but removed from shoulder 22 of shroud 11.

Shroud 11 provides a wall 20 having an inner surface 21 that faces toward the center of the ground opening that is to be covered. The inner surface 21 is preferably a cylindrically shaped surface for receiving a lid 12 that is preferably circular in shape. The periphery of lid 12 registers against and is closely spaced from the inner surface 21 of shroud 11. Shoulder 22 extends inwardly from the lower end portion of wall 20 and its inner surface 21. Shoulder 22 is preferably an annular shoulder that extends horizontally or perpendicular to inner surface 21. Shroud 11 can be connected (e.g. bolted) to wellhead shroud 24 that is preferably set at the ground surface, such as in a concrete mass 23. FIGS. 1, 1A, 2 and 3 show arrangements that can be retroactively fitted to an existing wellhead shroud 24. The existing wellhead shroud 24 has cylindrical side wall 26 and annular shoulder 27.

In the embodiment of FIGS. 1 and 2, the shroud 11 can be an existing shroud that occupies a position on the upper end portion of a well casing 27 or other elongated tubular structure that extends from the wellhead area downwardly into the well bore. The casing 27 provides a casing bore that can include one or more other well pipes 29. This upper end portion of well pipe 27 that can be fitted with shroud 11 provides a wellhead area 33 with ground opening 32 that is to be covered so that access to the well pipe bore 34 is prevented.

In FIG. 1, shroud 11 has an annular shoulder 35 that provides annular surface 36 upon which lid 12 rests when it is in a closed position of FIG. 1A. Wellhead shroud 24 has an inner surface 25 and a larger diameter side wall 26. Side wall 26 provides inner surface 25 that surrounds lid 12 when it is closed as shown in FIG. 1A. Wellhead shroud 24 includes annular shoulder 35, annular surface 36, smaller diameter side wall 37, and can be attached to the upper end portion of well casing 27 using fasteners 38, for example.

Figure 8:
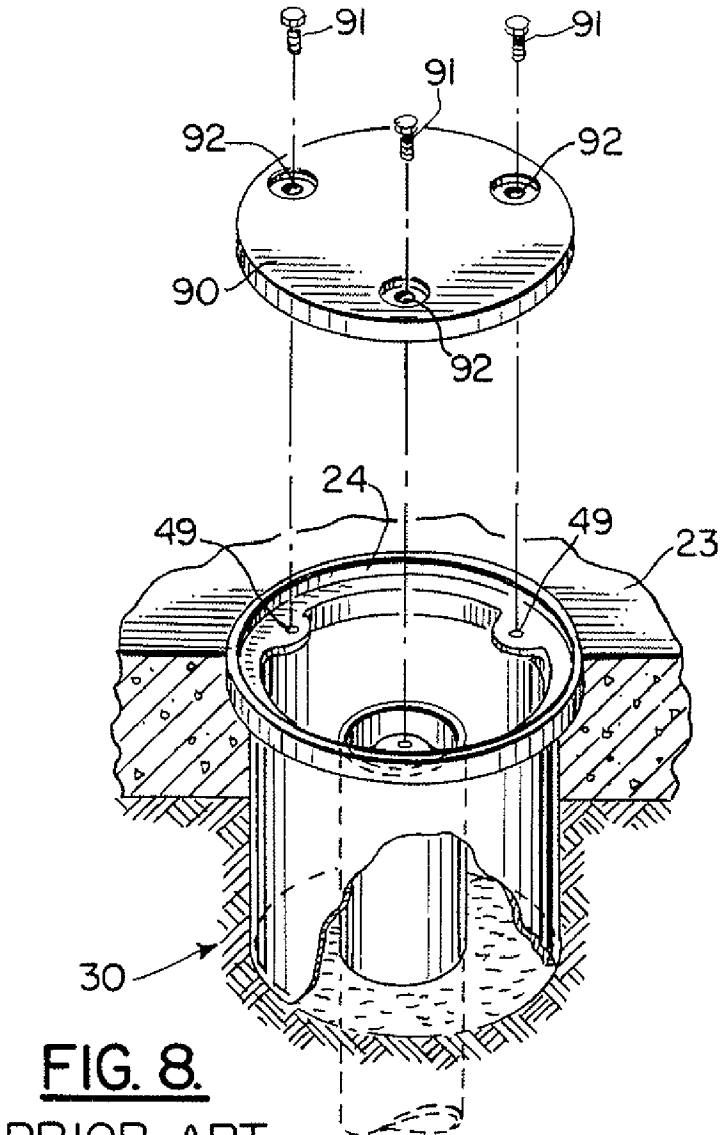
FIG. 8. PRIOR ART

Wellhead shroud 24 can have a plurality of existing openings 39 that, in the prior art, are used to bolt a cover 90 to wellhead shroud 24. Such a prior art arrangement is shown in FIG. 8.

Figure 9:
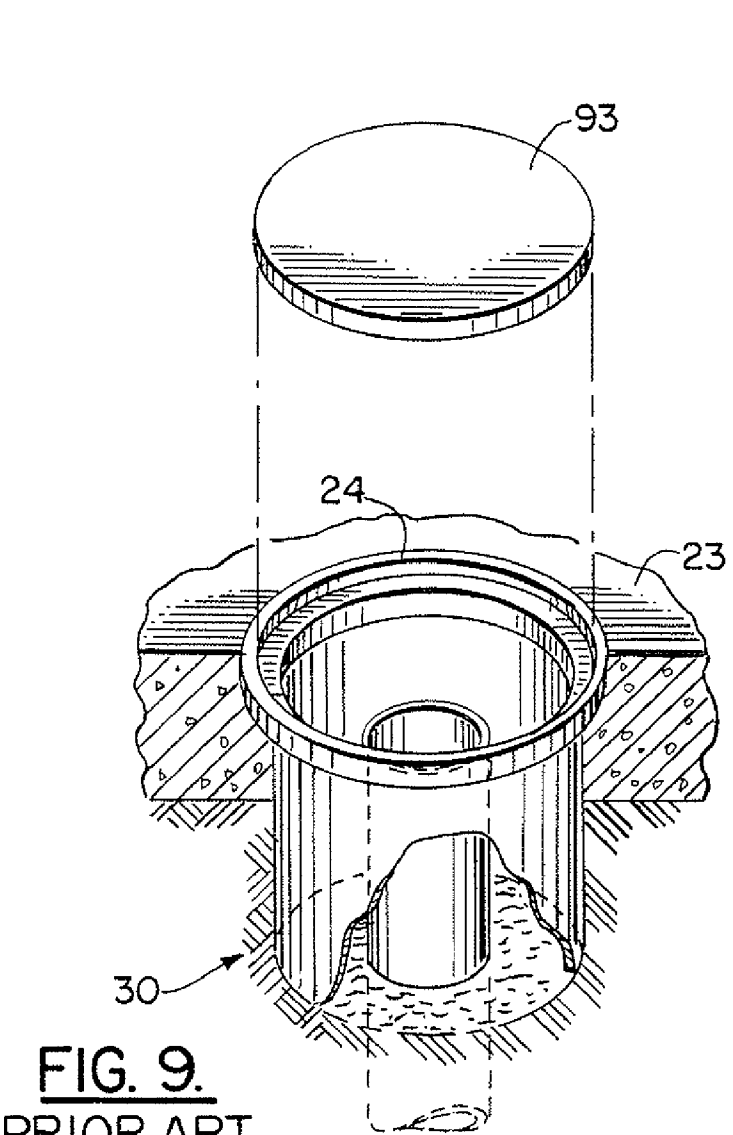
FIG. 9. PRIOR ART
FIGS. 8-9 are perspective exploded views of prior art well covers.

Another prior art arrangement is shown in FIG. 9 wherein a circular lid 93 rests upon shroud 24 but is not fastened thereto, simply being retained in position by gravity.

In FIG. 1, shroud 11 can be attached to existing wellhead shroud 24 by drill and tapping new openings 40 and fastening shroud 11 to existing shroud 24 using a plurality of bolts 41.

Figure 3:
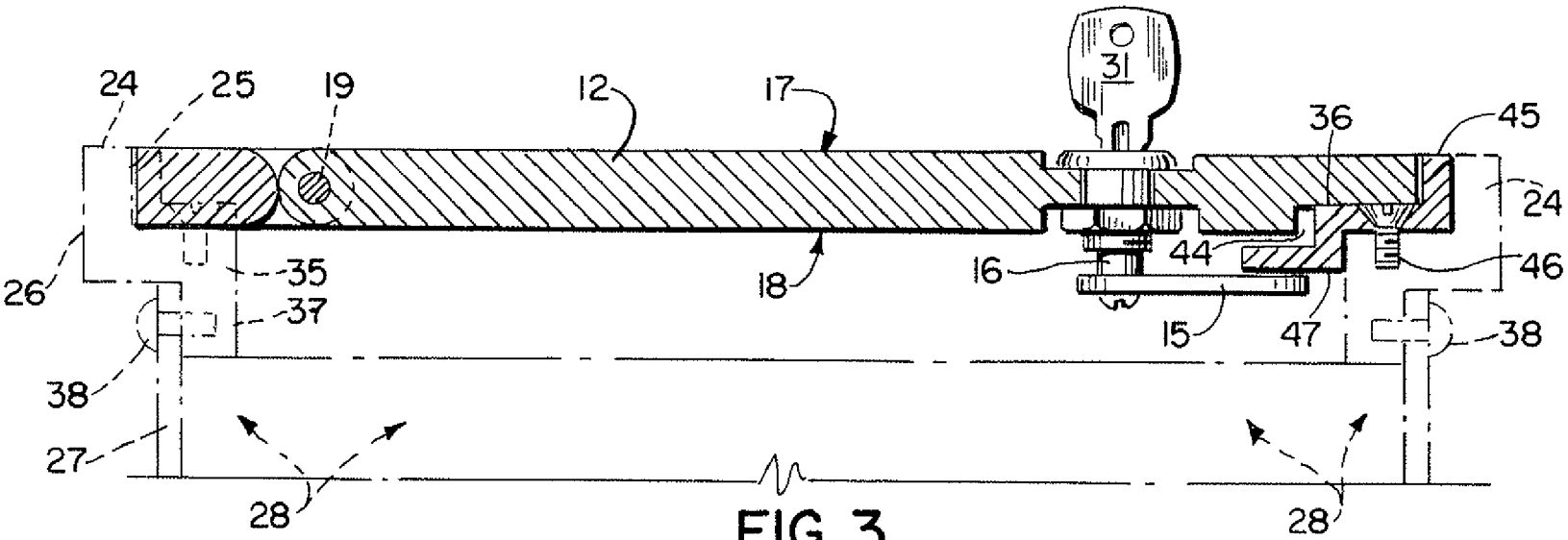
FIG. 3 is a sectional, elevation view of the preferred embodiment of the apparatus of the present invention.

In FIGS. 1 and 1A, lid 12 has a periphery 42 that provides an annular grove 43 that fits the contours of shroud 11 when lid 12 is in the closed position of FIG. 1A. Lid 12 has recess 44 for receiving part of static locking member 45. An inwardly projecting part 47 of static blocking member 45 extends under lid 12 when it is the closed position of FIGS. 1A and 3. In order to lock the lid 12 in a locking position of FIG. 3, key 31 is rotated so that locking arm 15 moves to a position under inwardly projecting part 47 as shown in FIG. 3. Static locking member 45 can be secured to shroud 11 using one or more fasteners 46.

In FIG. 2, a shroud 48 is similar in construction to the shroud 11 of FIG. 1. However, the shroud 48 of FIG. 2 provides openings 52 that align with existing openings 39 of wellhead shroud 24. Bolts or bolted connections 41 can be used to attach shroud 48 to wellhead shroud 24 at existing openings 39 on wellhead shroud 24.

Shroud 48 has a wall 49 that provides cylindrically shaped inner surface 50. Annular shoulder 51 receives the underside of lid 12 when the lid is in a closed position.

Figure 4:
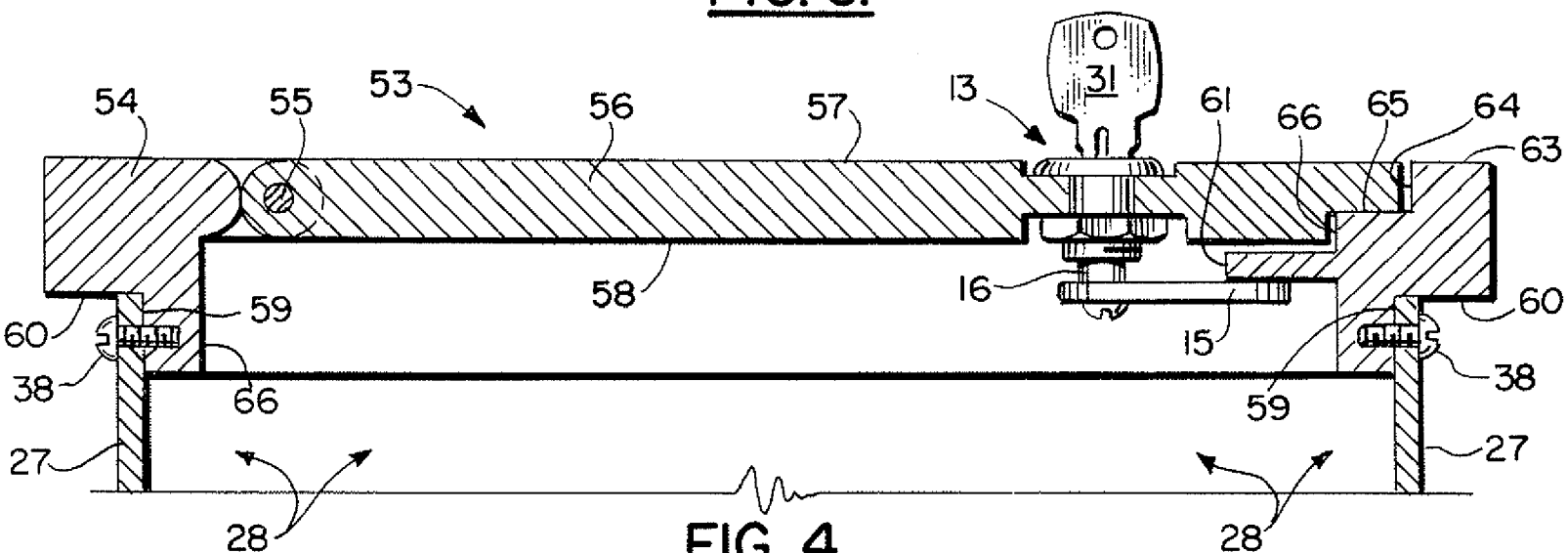
FIG. 4 is a sectional view of the second embodiment of the apparatus of the present invention.

An additional embodiment of the apparatus of the present invention is shown in FIG. 4. In FIG. 4, a newly constructed apparatus 53 is provided so that the locking ground opening cover 53 is a newly built structure that is fastened with fasteners 38 to the upper end portion of well casing 27. Locking ground opening cover 53 provides shroud 54 having a hinge 55 that connects lid 56 to it. Lid 56 provides upper surface 57, lower surface 58 and has a locking member 13 that accepts key 31. As with the embodiment of FIGS. 1-3, the locking member 13 provides a rotating member 16 and a locking arm 15. Shroud has cylindrical surface 59 that engages the inside surface of well casing 27 as shown in FIG. 4. A flat annular surface 60 defines a part of shroud 54 that extends radially away from well casing 27. An inwardly projecting part 61 of shroud 54 is provided for engaging locking arm 15 when the locking arm 15 is rotated to a locking position shown in FIG. 4. In the position of FIG. 4, the lid cannot be removed because the locking arm 15 engages inwardly projecting part 61.

Figure 5:
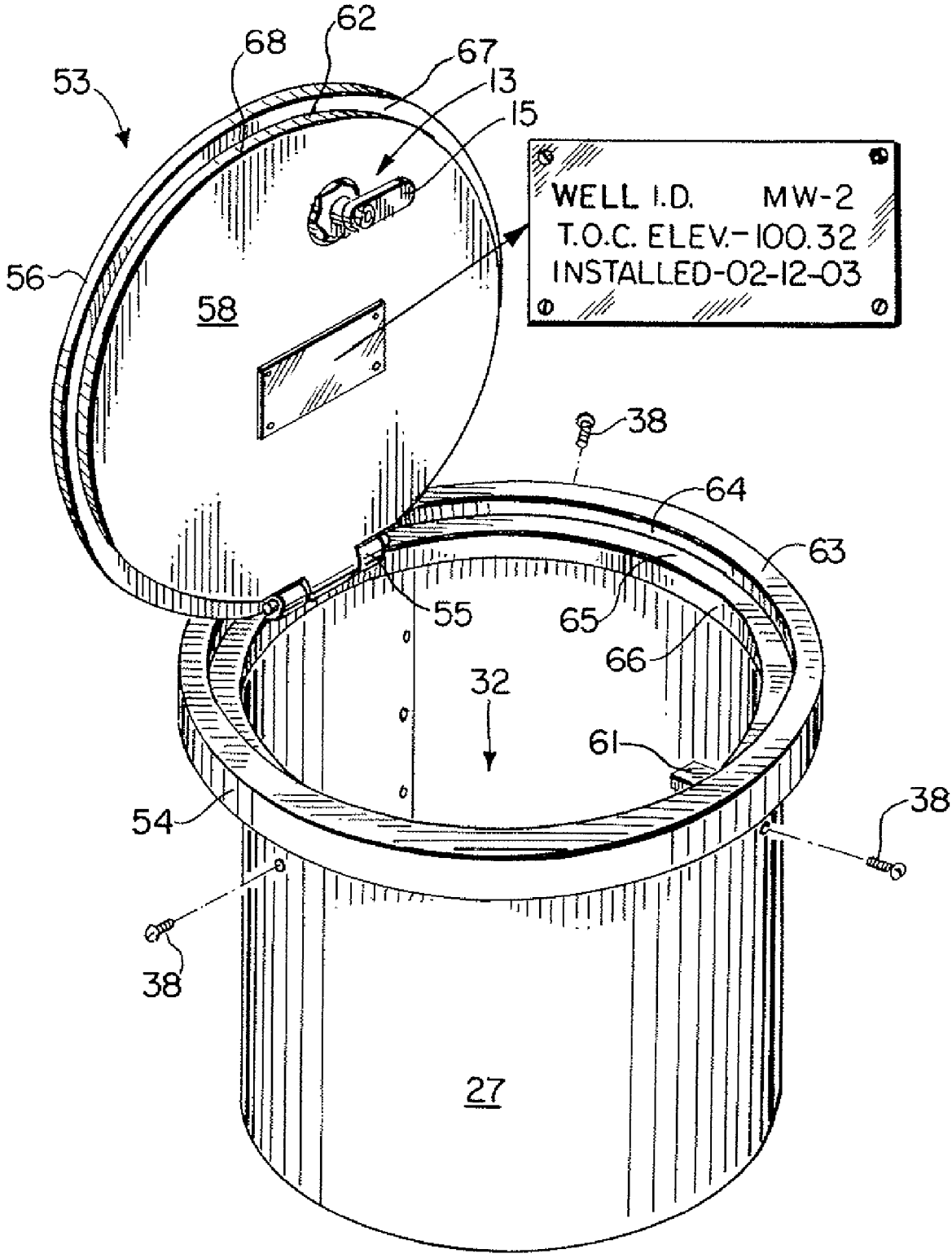
FIG. 5 is a perspective view of the preferred embodiment of the apparatus of the present invention.

Lid 56 has an annular groove 62 that fits surfaces 63 and 64 of shroud 54 as shown in FIGS. 4 and 5. The lower surface 58 of lid 56 rest upon flat annular surface 65 when the lid 56 is in a closed position of FIG. 4. An inner cylindrically shaped surface 66 defines an opening that enables access to ground opening 32 when lid 56 is in the open position of FIG. 27. Recess 62 can be defined by flat annular surface 67 and curved annular surface 68.

Figure 6:
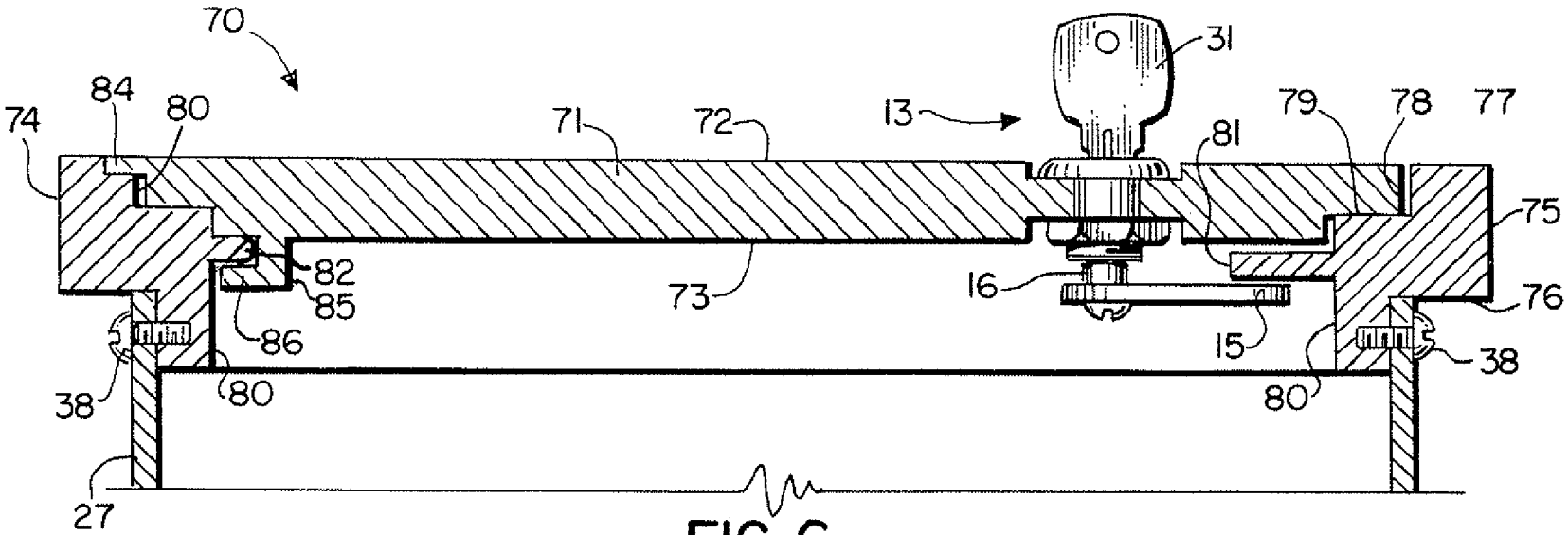
FIG. 6 is a sectional view of a third embodiment of the apparatus of the present invention.
Figure 7:
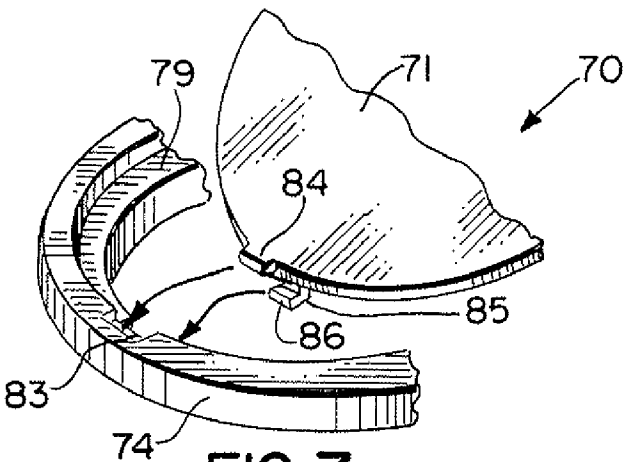
FIG. 7 is a fragmentary view of the third embodiment of the apparatus of the present invention.

Another locking ground opening cover 70 is shown in FIGS. 6 and 7. The embodiment of FIGS. 6 and 7 differs from the earlier embodiments because no hinge is provided. The locking ground opening cover 70 provides a lid 71 that attaches to shroud 74 in an interlocking fashion. Lid 71 has upper surface 72 and lower surface 73. Shroud 74 has an outer cylindrical surface 75, flat annular lower surface 76, flat annular upper surface 77, cylindrical surface 78, flat annular surface 79, and cylindrical surface 80.

Projecting portion 81 extends inwardly from surface 80 as shown in FIG. 6. Projecting portion 82 is engaged by ell shaped locking member 85 that can be an integral part of lid 71. The ell shaped locking member 85 provides a tab 86 that extends below projecting portion 82 as shown in FIG. 6. Shroud 74 has a recess 83 that accepts indexing tab 84. By placing indexing tab 84 in recess 83, an operator automatically aligns ell shaped locking member 85 with projecting portion 82. When so engaged, the lid 71 and shroud 74 are positioned so that projecting portion 81 aligns generally with locking mechanism 13. A user then rotates the key 31 and rotating part 16 of the locking mechanism 13 so that locking arm 15 occupies a position below projecting portion 81 thus preventing removal of the lid 71 from its position on shroud 74.

PARTS LIST

The following is a list of parts and materials suitable for use in the present invention:

| Part Number | Description |
|---|---|
| 10 | locking ground opening cover |
| 11 | shroud |
| 12 | lid |
| 13 | locking mechanism |
| 14 | key slot |
| 15 | locking arm |
| 16 | rotating section |
| 17 | upper surface |
| 18 | lower surface |
| 19 | hinge |
| 20 | wall |
| 21 | inner surface |
| 22 | annular shoulder |
| 23 | concrete mass |
| 24 | wellhead shroud |
| 25 | inner surface |
| 26 | Larger diameter side wall |
| 27 | well casing |
| 28 | casing bore |
| 29 | well pipe |
| 30 | well |
| 31 | key |
| 32 | ground opening |
| 33 | wellhead |
| 34 | well pipe bore |
| 35 | annular shoulder |
| 36 | annular surface |
| 37 | smaller diameter side wall |
| 38 | fastener |
| 39 | existing opening |
| 40 | new opening |
| 41 | bolt |
| 42 | periphery |
| 43 | annular groove |
| 44 | recess |
| 45 | static locking member |
| 46 | fastener |
| 47 | inwardly projecting part |
| 48 | shroud |
| 49 | wall |
| 50 | inner surface |
| 51 | annular shoulder |
| 52 | opening |
| 53 | locking ground opening cover |
| 54 | shroud |
| 55 | hinge |
| 56 | lid |
| 57 | upper surface |
| 58 | lower surface |
| 59 | cylindrical surface |
| 60 | flat annular surface |
| 61 | inwardly projecting part |
| 62 | annular groove |
| 63 | flat upper surface |
| 64 | curved annular surface |
| 65 | flat annular surface |
| 66 | curved annular surface |
| 67 | flat annular surface |
| 68 | curved annular surface |
| 69 | |
| 70 | locking ground opening cover |
| 71 | lid |
| 72 | upper surface |
| 73 | lower surface |
| 74 | shroud |
| 75 | cylindrical surface |
| 76 | flat annular lower surface |

-continued

| Part Number | Description |
|---|---|
| 77 | flat annular upper surface |
| 78 | cylindrical surface |
| 79 | flat annular surface |
| 80 | cylindrical surface |
| 81 | projecting portion |
| 82 | projecting portion |
| 83 | recess |
| 84 | indexing tab |
| 85 | ell shaped locking member |
| 86 | tab |
| 87 | |
| 88 | |
| 89 | |
| 90 | cover |
| 91 | bolt |
| 92 | opening |
| 93 | lid |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A locking cover that connects to a generally vertical pipe of a ground opening, comprising:

a) a vertical pipe mounted in the earth and having an upper end portion with a pipe diameter;

b) a shroud that is configured to be anchored to the earth at the ground opening, the shroud having an outer wall with an inner surface that has a shroud diameter greater than the pipe diameter, a central opening, and an annular ring having an annular shoulder that extends inwardly from the outer wall;

c) a lid that is movably attached to the annular ring of the shroud, the lid having a center and a peripheral portion that is sized and shaped to fit the annular ring, the lid having upper and lower surfaces, wherein the peripheral portion of the lid registers with and rests upon the annular shoulder of the annular ring when the lid is in a closed position;

d) a lock that extends through the lid at a position that is offset from the lid center, the lock communicating with the upper and lower surfaces of the lid at said peripheral portion, the lock including a key slot positioned next to the upper surface and a locking member that is movable between a first locking position that places the locking member under the annular ring and a second, unlocked position that removes the locking member from a position under the annular ring; and e) a key that is keyed to fit the lock and operate the lock, the key accessing the lock via the lid upper surface and lock opening, wherein operation of the key enables a user to place the locking member in the locking position that engages the shroud and enables a user to place the locking member in the unlocked position that disengages the locking member from the shroud.

2. The ground opening locking cover apparatus of claim 1 wherein the lid is hingedly connected to the shroud.

3. The apparatus of claim 1 wherein the shroud outer wall and the shoulder form an angle of between about 89 and 91 degrees.

4. The apparatus of claim 2 wherein the lid has an interlocking structure spaced circumferentially away from the lock that interlocks with the shoulder.

5. The apparatus of claim 4 wherein the interlocking structure includes first and second radially extending projecting portions extending both above and one below the shoulder.

6. The apparatus of claim 5 wherein at least one projecting portion extends very close to the inside surface of the outer wall, above the shoulder.

7. The apparatus of claim 1 further comprising indicia on the lower surface of the lid that carries data identifying an installation below the ground opening.

8. The apparatus of claim 1 wherein the lock is a rotating lock wherein rotation of the key rotates the locking member an equal rotational amount.

9. The apparatus of claim 1 wherein the lid is hingedly attached to the shroud and the lock is attached to the lid at a position that is spaced about 180 degrees from the hinge.

10. The cover of claim 1 wherein the lid is generally circular in shape and the upper surface of the lid has no openings other than the key slot.

11. The cover of claim 1 wherein the shroud is an existing shroud and the lid is a retrofit to the existing shroud.

12. The apparatus of claim 1 further comprising an intermediate annular ring nested in between the lid and the shroud, wherein the lid attaches to the intermediate ring and the intermediate ring is connected to the shroud with fasteners, the lid covering the fasteners when the lid is closed.

13. A locking cover for a ground opening, comprising:

a) a shroud anchored to the earth at the ground opening, the shroud having an outer wall with an inner surface, a central opening, and a shoulder that extends inwardly from the outer wall;

b) a lid that is selectively attachable to or completely removable from the shroud, the lid having a lid center and a periphery, the lid being is sized and shaped to fit the shroud and rest upon the shoulder when the lid is in a closed position, wherein an interlocking portion of the lid extends above and below the shoulder of the shroud at a first locking position;

c) a lock that extends through the lid at a position in between the lid center and the periphery, the lock communicating with the upper and lower surfaces of the lid, the lock including a key slot positioned next to the upper surface and a locking member that is movable between a first locking position that places the locking member under the shoulder and a second, unlocked position that disengages the locking member from the shoulder at a second position that is spaced away from the first position; and d) a key that is keyed to fit the lock and operate the locking member, the key accessing the lock via the lid upper surface and lock opening, wherein the key enables a user to place the locking member in the locking position and also enables a user to place the locking member in the unlocked position.

14. The cover of claim 13 wherein the shroud outer wall and the shoulder form an angle of between about 89 and 91 degrees.

15. The cover of claim 13 wherein the interlocking structure includes first and second radially extending projecting portions that extends, one above and one below, the shoulder.

16. The cover of claim 15 wherein at least one projecting portion extends very close to the inside surface of the outer wall, above the shoulder.

17. The cover of claim 13 further comprising indicia on the lower surface of the lid that carries data identifying an installation below the ground opening.

18. The cover of claim 13 wherein the lock is a rotating lock wherein rotation of the key rotates the loading member an equal rotational amount.

19. The cover of claim 13 wherein the lid is generally circular in shape and the upper surface of the lid has no openings other than the key slot.

20. The cover of claim 13 wherein the shroud is an existing shroud and the lid is a retrofit to the existing shroud.

21. The apparatus of claim 13 further comprising an intermediate annular ring nested in between the lid and the shroud, wherein the lid attaches to the intermediate ring and the intermediate ring is connected to the shroud with fasteners, the lid covering the fasteners when the lid is closed.

22. A locking cover for covering a ground opening, comprising:

a) a shroud anchored to the earth at the ground opening, the shroud having an outer wall with an inner surface, a central opening that registers with the ground opening, and a shoulder that extends inwardly from the outer wall;

b) a lid that is movably attached to the shroud, the lid having a lid center and a periphery that is sized and shaped to fit the shroud, the lid having upper and lower surfaces, a peripheral portion of the lid registering with and resting upon the shoulder when the lid is in a closed position, the lid having an opening positioned next to the lid periphery, said opening extending from the upper to the lower surface;

c) a locking device on the lid that occupies the lid opening, extending between the upper and lower surfaces and that includes a key slot positioned next to the upper surface and a locking member that is movable between a first locking position that places the locking member under the shoulder and a second, unlocked position that removes the locking member from the shoulder; and d) a key that is keyed to fit and operate the locking member, the key accessing the locking member via the lid upper surface and lock opening, wherein operation of the key enables a user to place the locking member in the locking position and also enables a user to place the locking member in the unlocked position.

23. The ground opening locking cover apparatus of claim 22 wherein the lid is hingedly connected to the shroud.

24. The apparatus of claim 22 wherein the shroud outer wall and the shoulder form an angle of between about 89 and 91 degrees.

25. The apparatus of claim 23 wherein the lid has an interlocking structure spaced circumferentially away from the lock that interlocks with the shoulder.

26. The apparatus of claim 25 wherein the interlocking structure includes first and second radially extending projecting portions that extends, one above and one below, the shoulder.

27. The apparatus of claim 26 wherein at least one projecting portion extends very close to the inside surface of the outer wall, above the shoulder.

28. The apparatus of claim 22 further comprising indicia on the lower surface of the lid that carries data identifying an installation below the ground opening.

29. The apparatus of claim 22 wherein the lock is a rotating lock wherein rotation of the key rotates the loading member an equal rotational amount.

30. The apparatus of claim 22 wherein the lid is hingedly attached to the shroud and the lock is attached to the lid at a position that is spaced from the hinge, the lid opening being the only opening that extends through the lid between the lid upper and lower surfaces.

31. The apparatus of claim 22 further comprising an intermediate annular ring nested in between the lid and the shroud, wherein the lid attaches to the intermediate ring and the intermediate ring is connected to the shroud with fasteners, the lid covering the fasteners when the lid is closed.

* * * * *